US012234055B2

(12) United States Patent
Apps et al.

(10) Patent No.: US 12,234,055 B2
(45) Date of Patent: Feb. 25, 2025

(54) KEG PALLET

(71) Applicant: Rehrig Pacific Company, Los Angeles, CA (US)

(72) Inventors: William P. Apps, Alpharetta, GA (US); Way Joe Lee, Marietta, GA (US)

(73) Assignee: Rehrig Pacific Company, Monterey Park, CA (US)

( * ) Notice: Subject to any disclaimer, the term of this patent is extended or adjusted under 35 U.S.C. 154(b) by 57 days.

(21) Appl. No.: 18/099,847

(22) Filed: Jan. 20, 2023

(65) Prior Publication Data

US 2023/0234750 A1 Jul. 27, 2023

Related U.S. Application Data

(60) Provisional application No. 63/345,632, filed on May 25, 2022, provisional application No. 63/302,064, filed on Jan. 22, 2022.

(51) Int. Cl.
*B65D 19/38* (2006.01)

(52) U.S. Cl.
CPC .. *B65D 19/385* (2013.01); *B65D 2519/00034* (2013.01); *B65D 2519/00129* (2013.01); *B65D 2519/00278* (2013.01); *B65D 2519/00288* (2013.01); *B65D 2519/00308* (2013.01); *B65D 2519/00318* (2013.01); *B65D 2519/00363* (2013.01); *B65D 2519/00965* (2013.01)

(58) Field of Classification Search
CPC ..... B65D 2519/00034; B65D 2519/00129; B65D 2519/00278; B65D 2519/00288; B65D 2519/00308; B65D 2519/00318; B65D 2519/00363; B65D 2519/00437; B65D 2519/00965; B65D 19/44
USPC ..... 108/57.13, 57.25
See application file for complete search history.

(56) References Cited

U.S. PATENT DOCUMENTS

| | | | | |
|---|---|---|---|---|
| 2,602,619 A | | 7/1952 | McIntyre | |
| 2,699,912 A | | 1/1955 | Cushman | |
| 3,664,271 A | * | 5/1972 | Wolder | B65D 19/0012 108/57.1 |
| 3,680,496 A | | 8/1972 | Westlake, Jr. | |
| 4,019,634 A | | 4/1977 | Bonnot | |
| 4,487,136 A | | 12/1984 | Beckway | |

(Continued)

FOREIGN PATENT DOCUMENTS

| | | |
|---|---|---|
| DE | 2125549 A1 | 12/1972 |
| GB | 1463485 A | 2/1977 |

(Continued)

*Primary Examiner* — Matthew W Ing
(74) *Attorney, Agent, or Firm* — Carlson, Gaskey & Olds, P.C.

(57) ABSTRACT

A pallet includes a deck having center portion and two outer portions spaced outward on either side of the center portion. A plurality of keg supports extend from each outer portion to the center portion. Each keg support has a concave upper surface. A large opening is defined between each adjacent pair of keg supports. Outer middle recesses are formed on each outer portion adjacent each large opening. Center middle recesses are formed on the center portion adjacent each large opening. A plurality of column portions protrude from the deck. The pallet accommodates both straight kegs and belly kegs at the same height. The pallet may be formed in two identical halves.

35 Claims, 13 Drawing Sheets

(56) References Cited

U.S. PATENT DOCUMENTS

| | | | | |
|---|---|---|---|---|
| 4,597,338 | A | 7/1986 | Kreeger | |
| 4,604,014 | A | 8/1986 | Frano | |
| 4,606,278 | A | 8/1986 | Shuert | |
| 4,735,154 | A * | 4/1988 | Hemery | B65D 19/0012 108/56.1 |
| 4,850,284 | A | 7/1989 | DeGroot et al. | |
| 4,879,956 | A | 11/1989 | Shuert | |
| 5,042,396 | A | 8/1991 | Shuert | |
| 5,094,175 | A | 3/1992 | Christie | |
| 5,289,781 | A | 3/1994 | Beckway | |
| 5,390,467 | A | 2/1995 | Shuert | |
| 5,401,347 | A | 3/1995 | Shuert | |
| 5,404,829 | A | 4/1995 | Shuert | |
| 5,483,899 | A | 1/1996 | Christie | |
| 5,520,120 | A | 5/1996 | Badger | |
| 5,579,686 | A | 12/1996 | Pigott et al. | |
| 5,813,355 | A | 9/1998 | Brown et al. | |
| 5,950,545 | A | 9/1999 | Shuert | |
| 5,996,508 | A | 12/1999 | Constantino et al. | |
| 6,006,677 | A | 12/1999 | Apps et al. | |
| 6,021,721 | A | 2/2000 | Rushton | |
| 6,029,583 | A | 2/2000 | LeTrudet | |
| 6,109,190 | A | 8/2000 | Hale et al. | |
| 6,199,487 | B1 | 3/2001 | Coddington | |
| 6,283,044 | B1 | 9/2001 | Apps | |
| 6,564,725 | B2 | 5/2003 | Hale | |
| 6,574,934 | B1 | 6/2003 | Queirel | |
| 6,705,237 | B2 | 3/2004 | Moore, Jr. et al. | |
| 6,718,888 | B2 | 4/2004 | Muirhead | |
| 6,742,460 | B2 | 6/2004 | Meyer et al. | |
| 6,886,475 | B2 | 5/2005 | Apps et al. | |
| 7,146,773 | B2 | 12/2006 | Wilson | |
| 7,343,865 | B2 | 3/2008 | Shuert | |
| 8,291,839 | B2 | 10/2012 | Apps et al. | |
| 8,770,115 | B2 | 7/2014 | Apps et al. | |
| 11,066,210 | B1 * | 7/2021 | Ankele | B65D 19/42 |
| 2005/0056193 | A1 * | 3/2005 | Laender | B65D 19/0081 108/56.3 |
| 2007/0221593 | A1 * | 9/2007 | Apps | B65D 19/44 211/74 |
| 2011/0259249 | A1 | 10/2011 | Ogburn et al. | |
| 2013/0206043 | A1 * | 8/2013 | Baltz | B65D 19/0038 108/51.11 |

FOREIGN PATENT DOCUMENTS

| | | | |
|---|---|---|---|
| WO | 2005118412 | A1 | 12/2005 |
| WO | 2009099314 | A1 | 8/2009 |
| WO | 2010008264 | A1 | 1/2010 |

* cited by examiner

KEG PALLET

BACKGROUND

In North America, breweries primarily use "straight" kegs with a fairly constant diameter between the upper chime and the lower chime with the exception of two small rings in a middle area of the keg. The straight keg includes a cylindrical wall between the upper chime and the lower chime. The cylindrical wall has an increased radius forming the two small rings. The cylindrical wall has a radius substantially equal to that of the upper chime and the lower chime, but for the increased radius forming the two small rings.

Some breweries use a "belly" keg. The belly keg has a middle area that has a significantly larger diameter than the upper chime and lower chime. The middle area also has two spaced-apart small rings that increase the diameter a little further. The belly keg also has an upper area and a lower area that each taper outward from the respective chime toward the middle area. Over time, the shape of the middle area of the belly keg can change and the dimensions can increase.

SUMMARY

A pallet described herein accommodates both straight kegs and belly kegs at the same stacking height. Straight kegs will be supported on the pallet at their upper and lower chimes, which provide a consistent radius. The large-radius middle areas of the belly kegs will be received in recesses in the pallet. This compensates for the different shapes and radii of the two keg types such that another pallet will be at the same height whether it is stacked on straight kegs or belly kegs or a mixture of both. The pallet may include elongated reinforcements to compensate for the loss of strength caused by the recesses.

The pallet may be formed in two identical halves which may be connected together to form "leg in leg" or double-walled columns. The pallet includes a deck having a center portion and two outer portions spaced outward on either side of the center portion. A plurality of keg supports extend from each outer portion to the center portion. Each keg support has a concave upper surface. A large opening is defined between each adjacent pair of keg supports. Outer middle recesses are formed on each outer portion adjacent to each large opening. Center middle recesses are formed on the center portion adjacent to each large opening. A plurality of column portions protrude from the deck.

DETAILED DESCRIPTION

Figure 1:
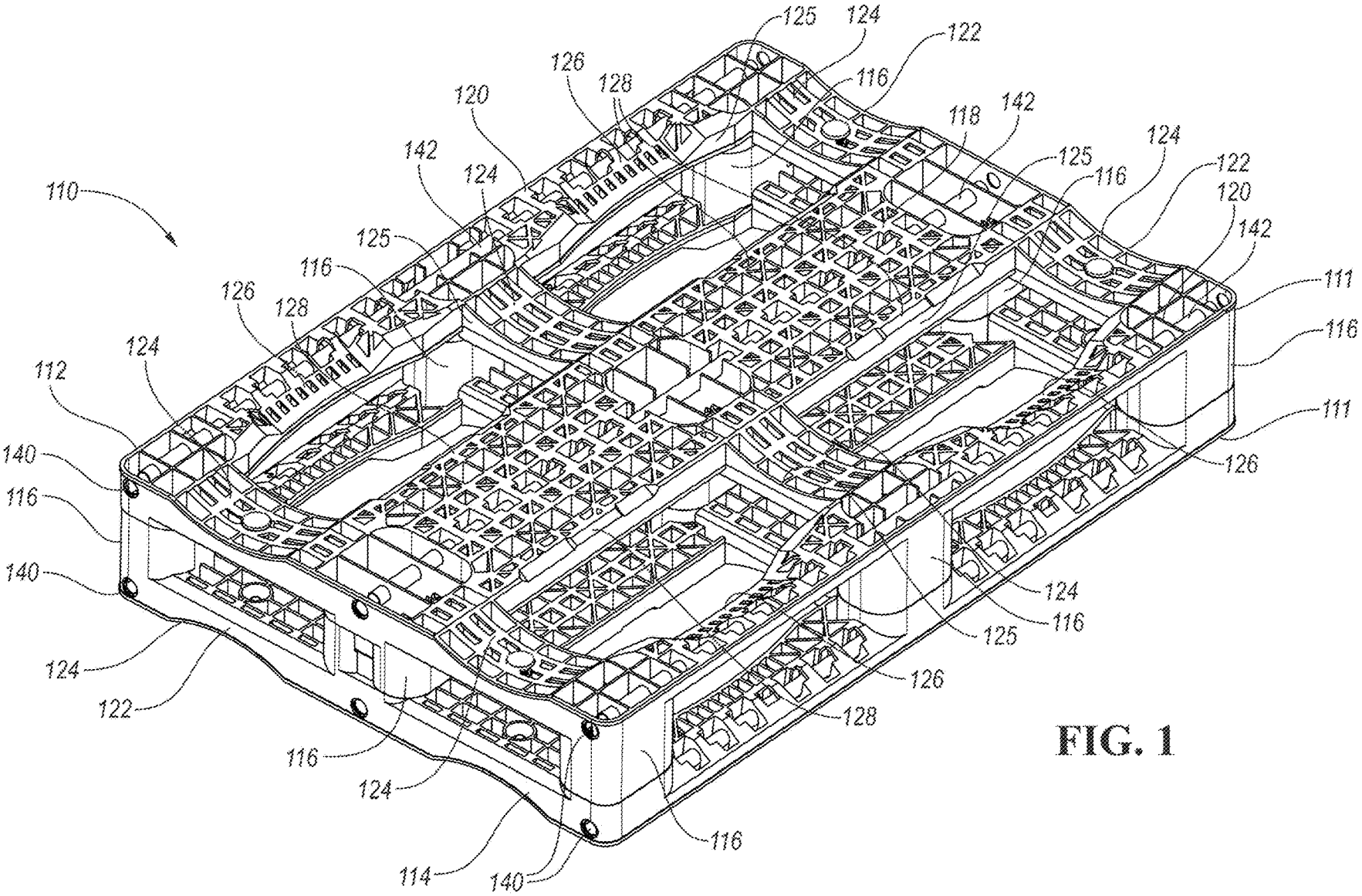
FIG. 1 is a perspective view of one embodiment of a pallet.

A pallet 110 according to one embodiment is shown in FIG. 1. The pallet 110 is compatible with both straight kegs and belly kegs. The pallet 110 in this example embodiment is injection-molded as two identical halves 111 that are mated together via the columns to provide "leg in leg" columns, i.e. double-wall thickness columns. One advantage of identical pallet halves 111 is that a single cavity mold can make a full pallet every two shots. However, the leg in leg columns are optional and other manufacturing techniques could be used.

The pallet 110 includes an upper deck 112, a lower deck 114 and columns 116 between the upper deck 112 and the lower deck 114. The upper deck 112 and the lower deck 114 in this embodiment are identical so that the pallet 110 is reversible and so that identical halves 111 can be made in the same mold.

The upper deck 112 includes a center portion 118 and two outer portions 120 spaced outward on either side of the center portion 118. The center portion 118 and the two outer portions 120 extend parallel to one another along a longitudinal axis of the pallet 110, which is the longest dimension of the pallet 110. The columns 116 extend downward from the center portion 118 and the two outer portions 120. The upper deck 112 includes a pair of parallel longitudinally elongated cylindrical concave keg recesses 122. The keg recesses 122 are between the center portion 118 and each of the two outer portions 120. Three keg supports 124 extend from each of the two outer portions 120 to the center portion 118. The keg supports 124 each include a concave upper surface that is concave about an axis extending parallel to the longitudinal dimension of the pallet 110. Large openings 125 are defined between each adjacent pair of keg supports 124 within each keg recess 122.

Outer middle recesses 126 are formed at the upper corner of each outer portion 120 adjacent each opening 125. Center middle recesses 128 are formed at the upper corner of the center portion 118 adjacent to each opening 125.

Elongated channels 140 are formed through the corner columns 116 and through each of the two outer portions 120 from one corner column 116 to the other. The elongated channels 140 extend in a direction parallel to the longest axis of the pallet 110. Optional elongated reinforcement members 142 are received in the elongated channels 140.

Figure 2:
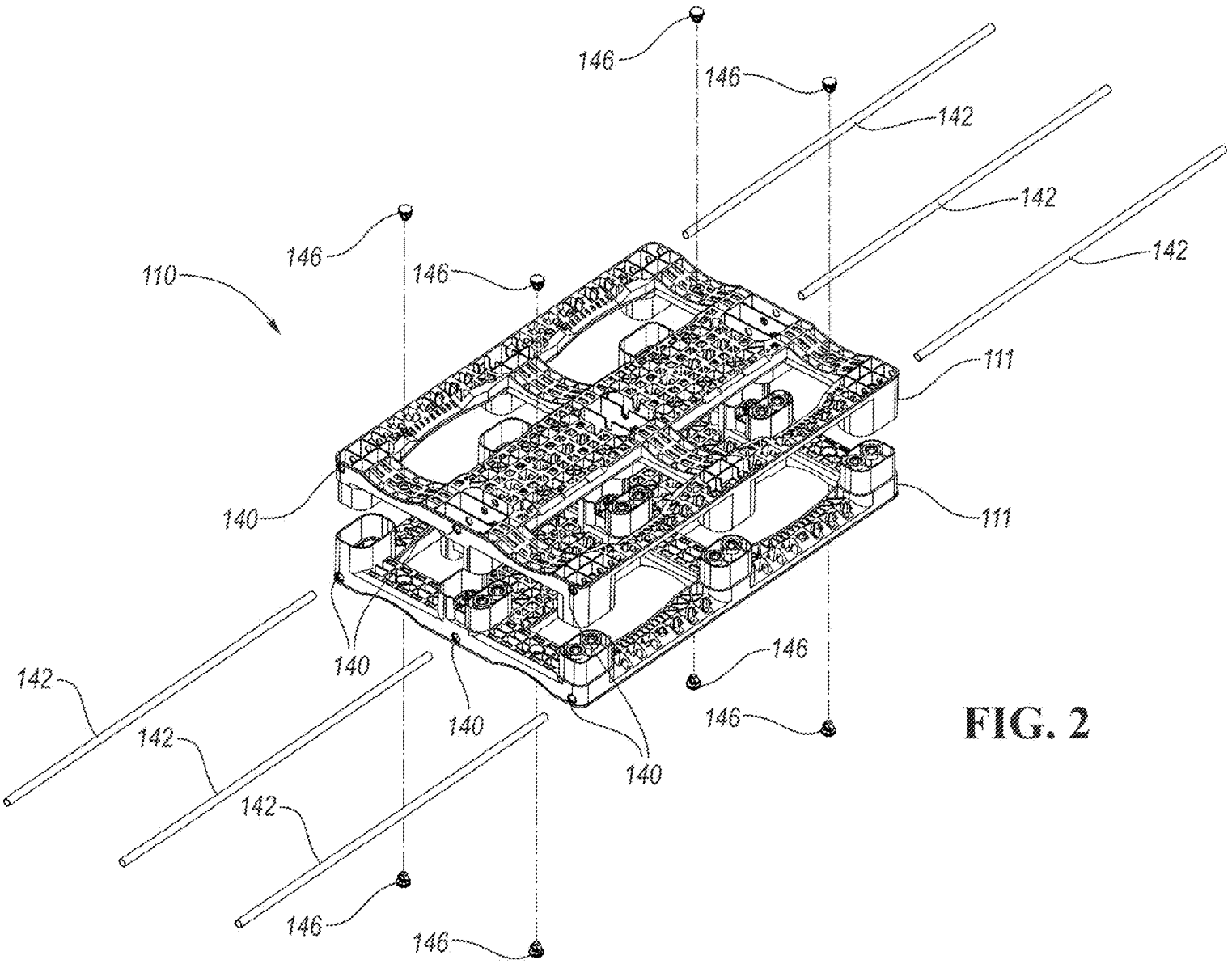
FIG. 2 is an exploded view of the pallet.

FIG. 2 is an exploded view of the pallet 110. In this embodiment, the two outer portions 120 are fairly thin in the area of the outer middle recess 126. The elongated reinforcement members 142 received in the elongated channels 140 reinforce these areas. The elongated reinforcement members 142 may be round, rectangular, or square in cross-section, but in the example shown they are round to eliminate any stress concentrations that would result from square or rectangular holes in this thin area. Also, the round elongated reinforcement members 142 drain liquids more easily. The reinforcement is particularly beneficial because tines inserted between the columns 116 on the long side of the pallet 110 would lift the pallet 110 (and any kegs on the pallet 110 and any kegs/pallets stacked on the pallet 110) by contacting (in part) at or near the thin parts of the outer portions 120. For this reason, the four outer portions 120 (top and bottom) include four elongated reinforcement members 142 in this design.

FIG. 2 also shows optional elongated reinforcement members 142 in the center portions 118. Although the center portion 118 is robust in design, the belly keg support in the center is over a very small area. The need for elongated reinforcement members 142 in the center portion 118 may depend on material selection.

Optional grommets 146 (e.g. four) are also shown. The optional grommets 146 on the keg supports 124 would contact the straight keg only and prevent end to end movement during handling. The belly keg sits deep into the outer middle recess 126 so it does not need grommets. The bumper rings on the straight keg also sit into shallower recesses. However, there are several generations of straight kegs and the location of the bumper rings varies significantly top to bottom so some movement would be possible.

Figure 3:
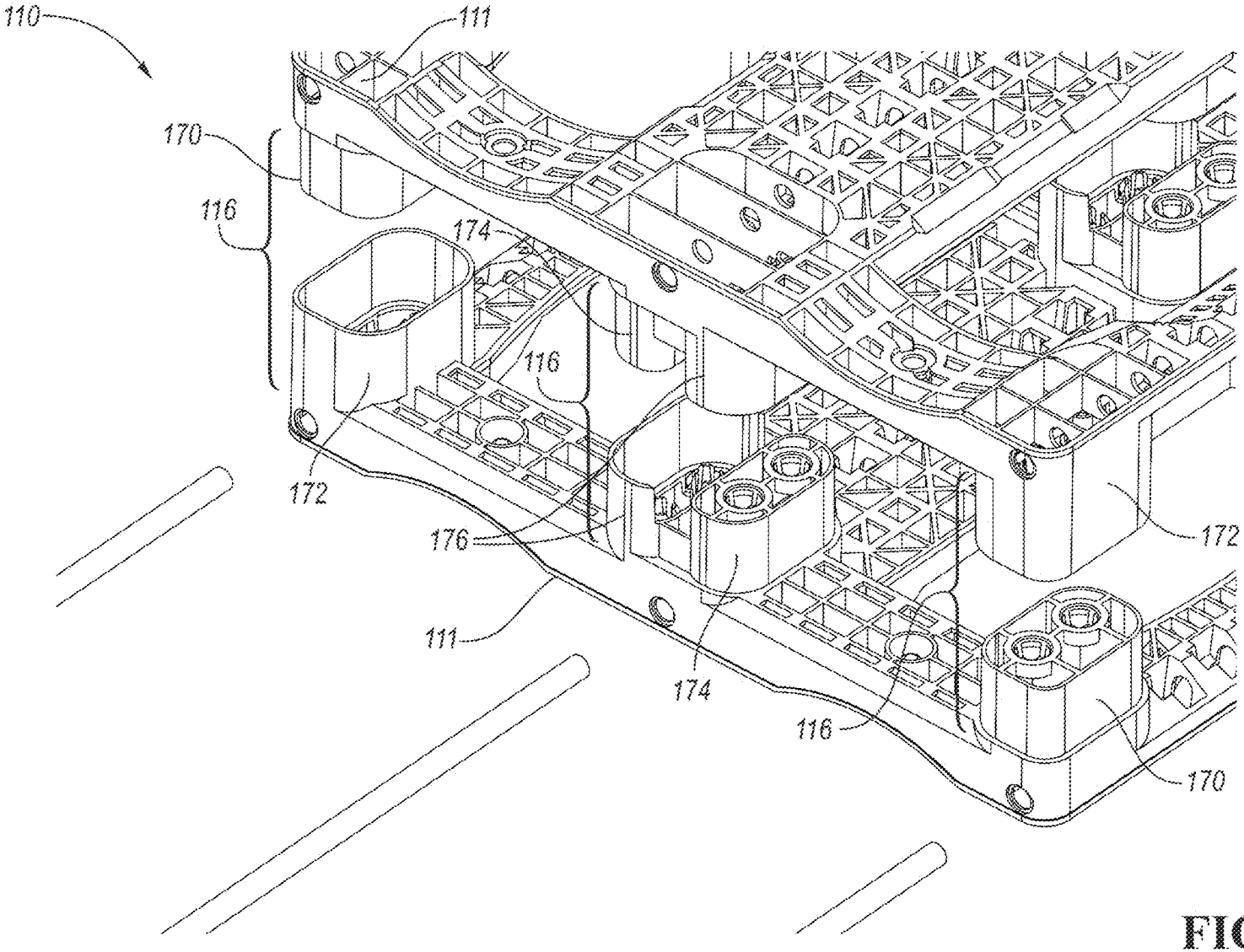
FIG. 3 is an enlarged view of one end of the exploded pallet of FIG. 2.

FIG. 3 is an enlarged view of one end of the exploded pallet 110 of FIG. 2. As shown, the upper half 111 is rotated 180 degrees about its long axis relative to the lower half 111. Each half 111 includes a longitudinal row of male column portions 170 along one long side and a longitudinal row of complementary female column portions 172 along the opposite long side. The outer elongated channels 140 are aligned toward an outer edge of the male column portions 170 and the complementary female column portions 172.

Along the longitudinal center line, a row of column sets each have a male column portion 174 and a complementary female column portion 176 offset on either side of the longitudinal center line. In this example, each male column portion 174 is spaced away from the complementary female column portion 176, and the elongated channel 140 is aligned along the longitudinal center line, which would be aligned between the male column portion 174 and the complementary female column portion 176. In this example, there are three male column portions 170 along one long side three complementary female column portions 172 along the opposite long side. In this example, there are three pairs of male column portions 174 and complementary female column portions 176 along the longitudinal center line.

As can be seen in FIG. 3, when the upper half 111 is rotated about the longitudinal centerline, the complementary female column portions 172 of each half 111 are aligned with the male column portions 170 of the other half 111. Also, the complementary female column portions 176 of one half 111 are aligned with the male column portions 174 of the other half 111.

As can also be seen in FIG. 3, the elongated channels 140 are defined by aligned apertures through the ribs that comprise the center portion 118 and the outer portions 120.

Figure 4:
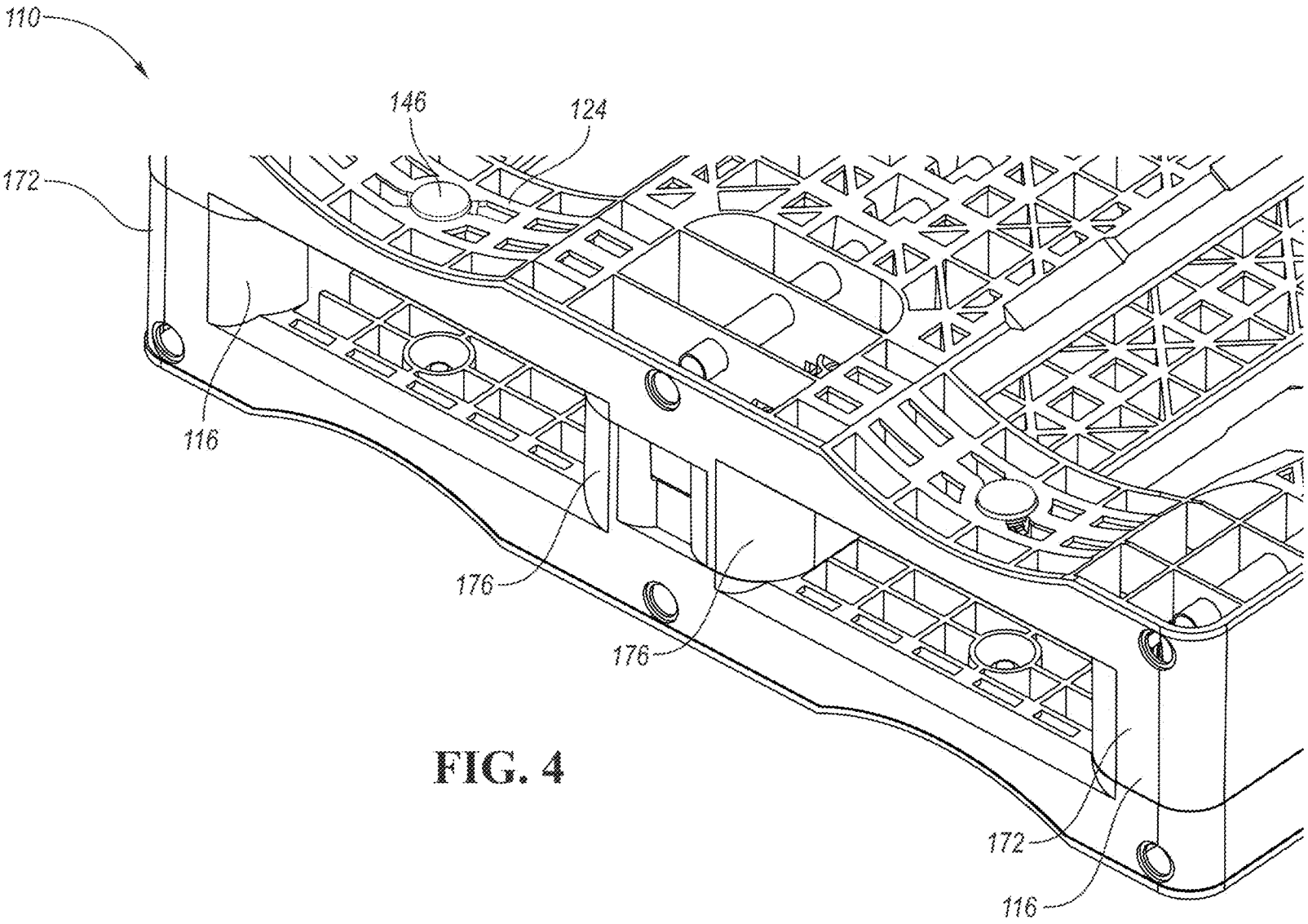
FIG. 4 shows the end of the pallet of FIG. 3 assembled.

As shown in FIG. 4, the halves 111 are connected to form the pallet 110 by inserting all of the male column portions 170 into the complementary female column portions 172 and by inserting all of the male column portions 174 into the complementary female column portions 176. The halves 111 may be secured together via a snap-fit connection, adhesive, hot plate welding, welding, fasteners, etc, or some combination thereof. FIG. 4 also shows the optional grommets 146 inserted into apertures through the keg supports 124.

Figure 5:
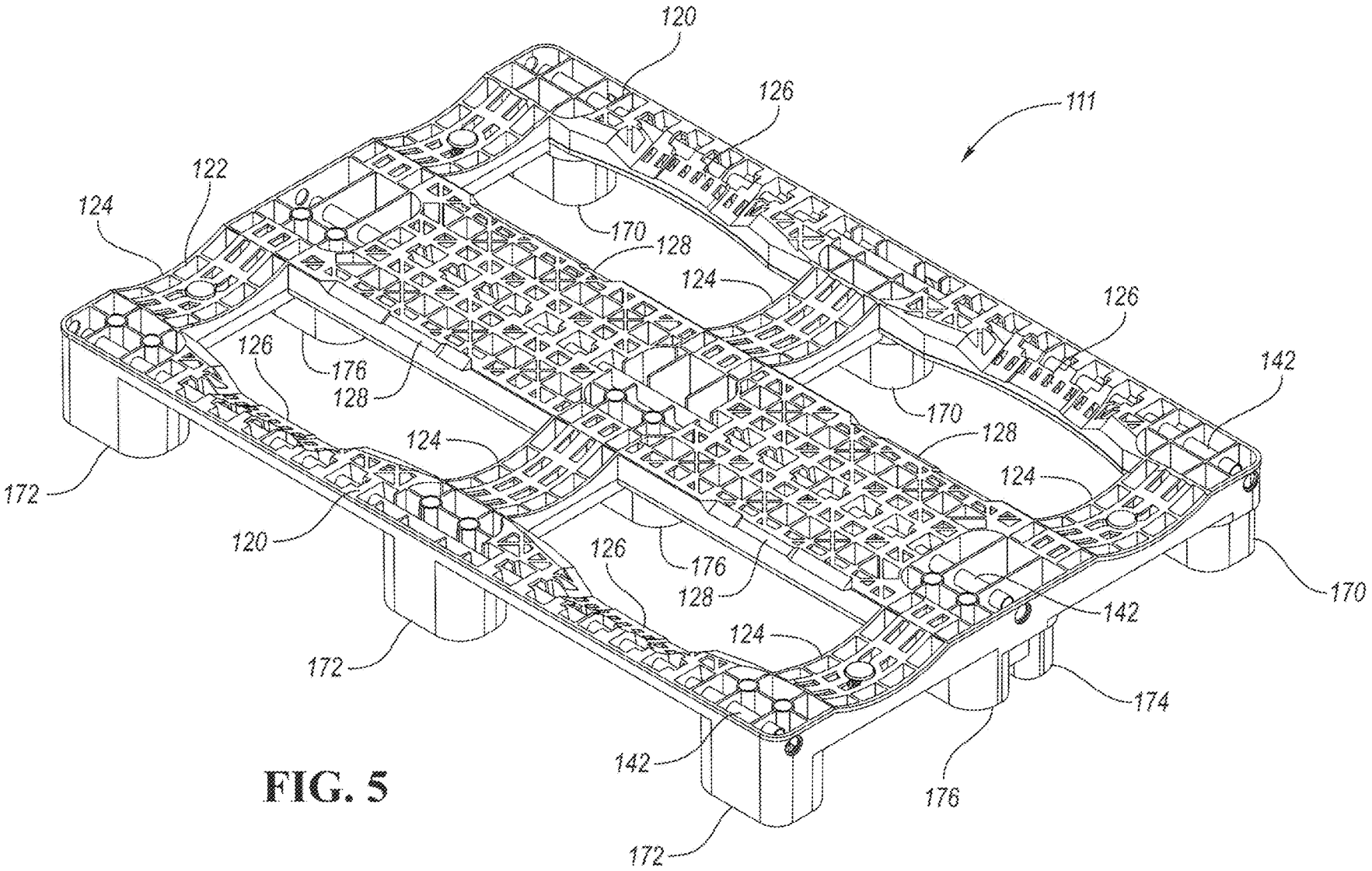
FIG. 5 is an upper perspective view of the pallet half.

FIG. 5 is an upper perspective view of the pallet half 111. The arrangement of the male column portions 170, complementary female column portions 172, male column portions 174, and complementary female column portions 176 is more clearly shown in FIG. 5. The male column portions 170, complementary female column portions 172, male column portions 174, and complementary female column portions 176 are all integrally molded with the deck as the pallet half 111.

Figure 6:
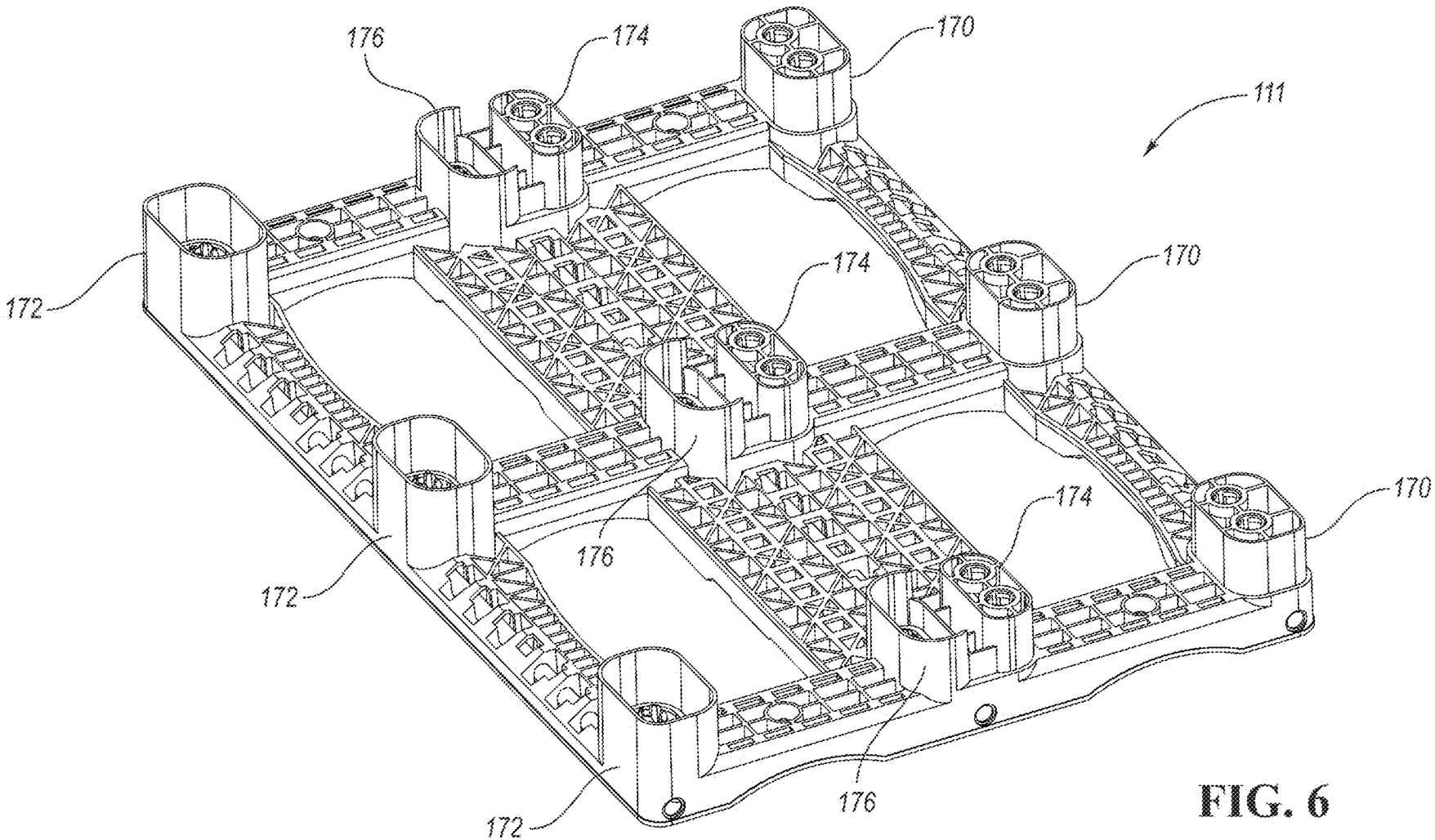
FIG. 6 is a bottom perspective view of the pallet half.

FIG. 6 is a bottom perspective view of the pallet half 111. The arrangement of the male column portions 170, complementary female column portions 172, male column portion 174, and complementary female column portion 176 is shown in FIG. 6. Although other arrangements could be used in which identical halves could still mate, in this embodiment, the male column portions 170 are along one long side of the pallet half 111 and the complementary female column portions 172 are along the opposite long side of the pallet half 111. Alternatively, any of the male column portions 170 could be on either long side of the pallet half 111 as long as there is a complementary female column portion 172 aligned with it on the opposite long side of the pallet half 111.

The male column portions 170 each have a rectangular peripheral wall with rounded corners that is elongated in the direction of the long dimension of the pallet half 111. Ribs inside the male column portions 170 provide reinforcement. The female column portions 172 each have a rectangular peripheral wall with rounded corners that is elongated in the direction of the long dimension of the pallet half 111.

Along the longitudinal center line, the male column portions 174 are on one side of the longitudinal center line and the complementary female column portions 176 are on the other side of the longitudinal center line. Any or all of the male/female pairs could be flipped and they would still mate with an identical pallet half 111.

The female column portions 176 each have a peripheral wall that is rectangular with round corners or they can be stadium-shaped. The inner portion of the peripheral wall is approximately half the height of the remainder of the peripheral wall. The inner portion of the peripheral wall of each of the female column portions 176 is spaced away from an inner portion of a peripheral wall of the corresponding male column portion 174. The peripheral wall of each male column portion 174 is rectangular with round corners or stadium-shaped and has reinforcing ribs therein. Spacer ribs connect the inner portions of the peripheral walls of the female column portions 176 to the inner portions of the peripheral walls of the male column portions 174. The spacer ribs are approximately half the height of the female column portions 176 and the male column portions 174.

Figure 7:
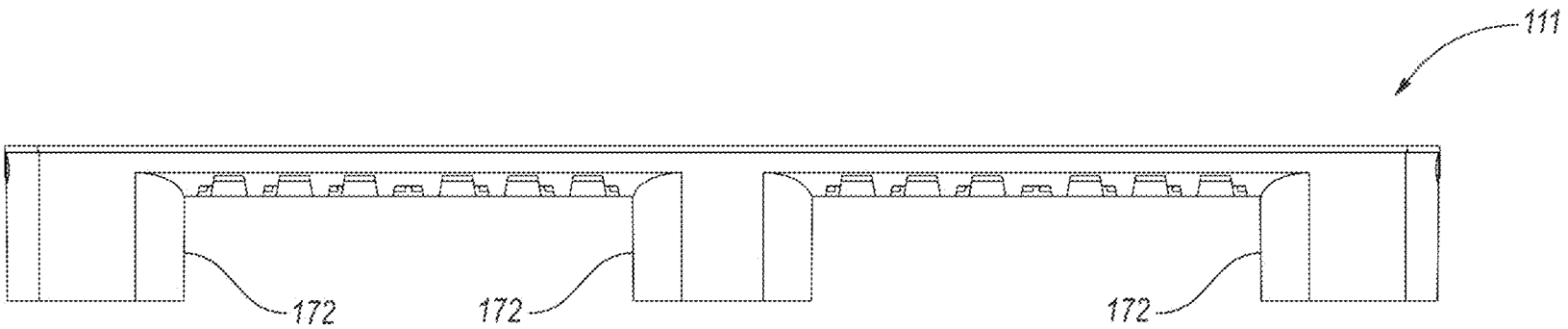
FIG. 7 is a side view of the pallet half.
Figure 8:
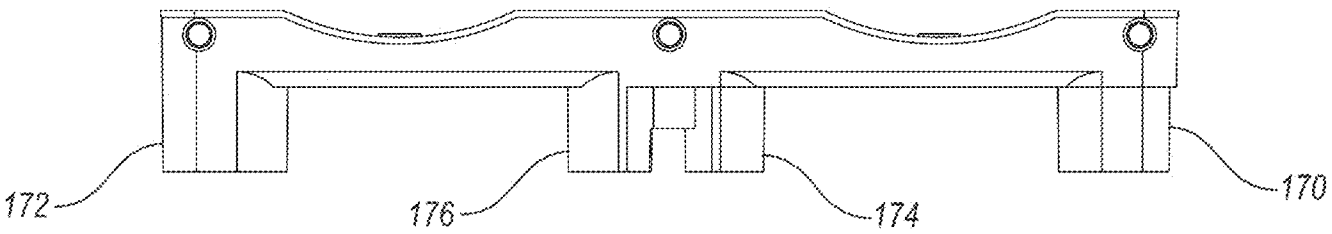
FIG. 8 is an end view of the pallet half.

FIG. 7 is a side view of the pallet half 111 showing the complementary female column portions 172. FIG. 8 is an end view of the pallet half 111 showing one of the male column portions 170, one of the complementary female column portions 172, one of the male column portions 174 and one of the complementary female column portions 176.

Figure 9:
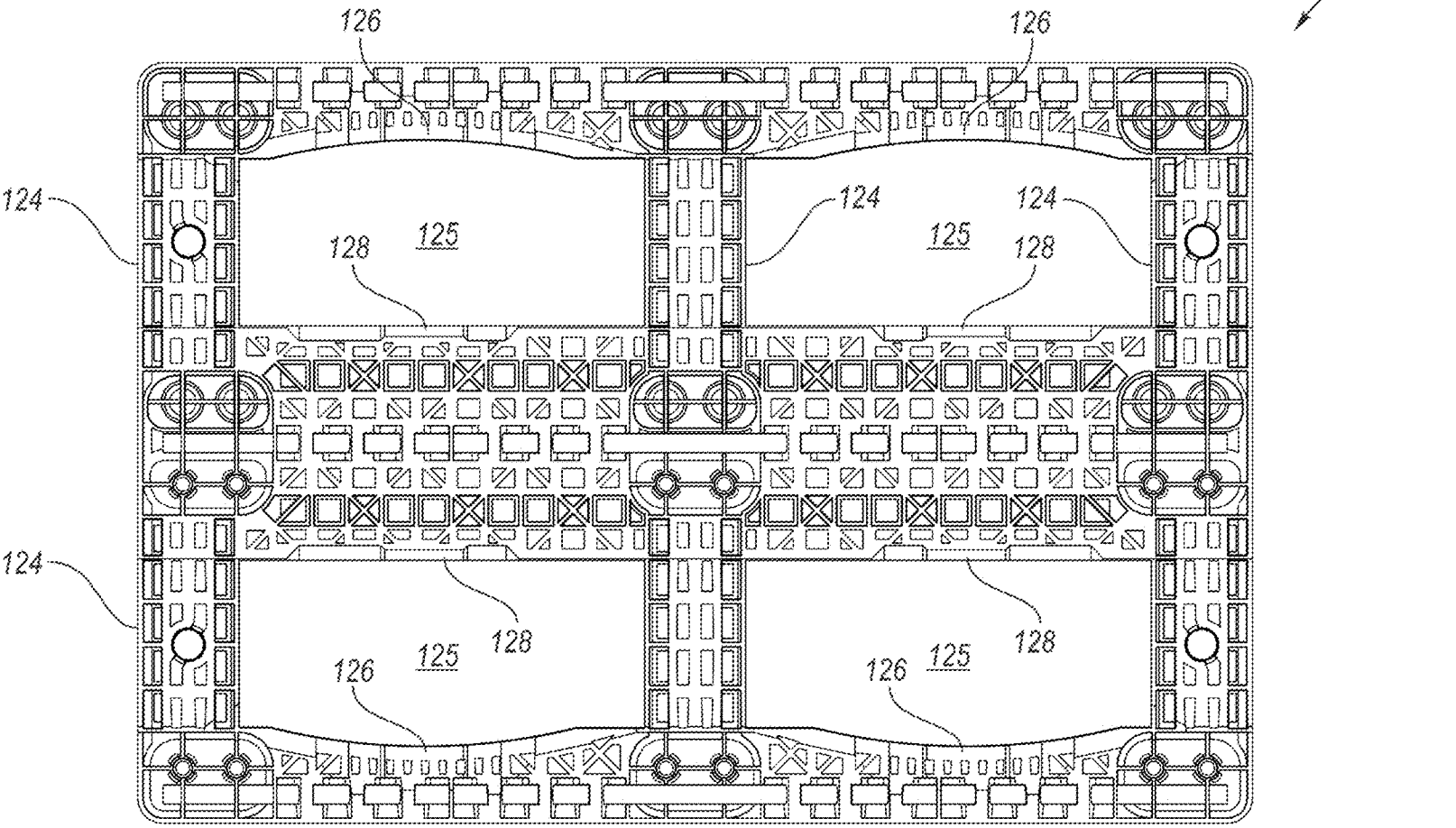
FIG. 9 is a top view of the pallet half.
Figure 10:
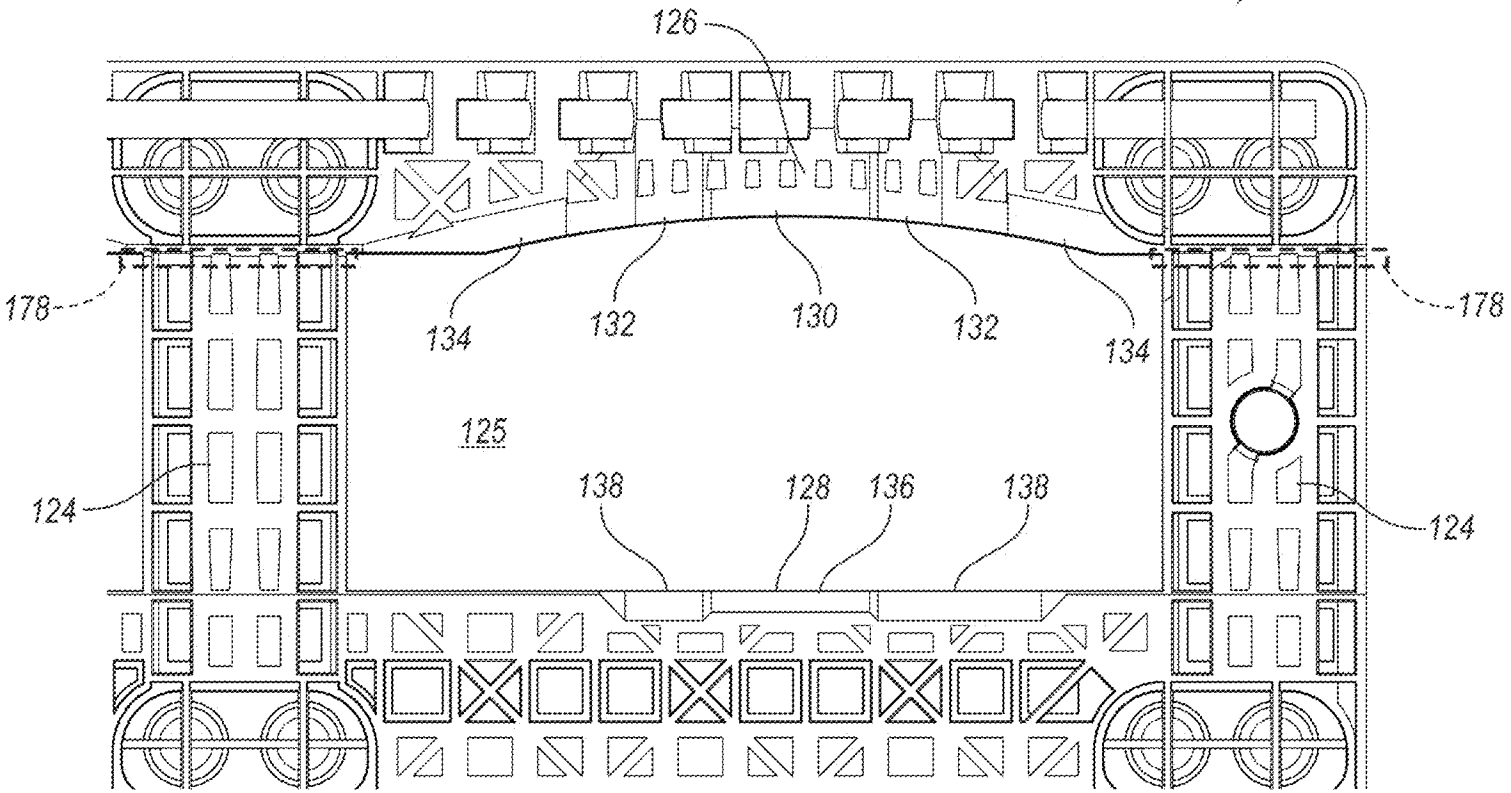
FIG. 10 is an enlarged view of one quadrant of the pallet half of FIG. 11.

FIG. 9 is a top view of the pallet half 111. FIG. 10 is an enlarged view of one quadrant of the pallet half of FIG. 111. The other quadrants would be symmetrical. The outer middle recess 126 and center middle recess 128 are shown in more detail.

The outer middle recess 126 includes an outer center recess portion 130 that is cylindrical concave. On either side of the outer center recess portion 130 is a ring recess portion 132 that is cylindrical concave and narrower than the outer center recess portion 130. The ring recess portions 132 may be deeper (downward and outward) than the center recess portion 130, as shown. Alternatively, the radius of the center recess portion 130 may be increased to match that of the ring recess portions 132. Outward of the two ring recess portions 132 are tapered portions 134 that are conical concave. The inner upper corner of the outer portion 120 may be slightly beveled or cylindrical concave, as shown.

The center middle recess 128 includes an inner center recess 136 aligned with the outer center recess portion 130.

Inner ring recess portions 138 are formed on either side of the inner center recess 136 and align (at least partially) with in ring recess portions 132.

Figure 11:
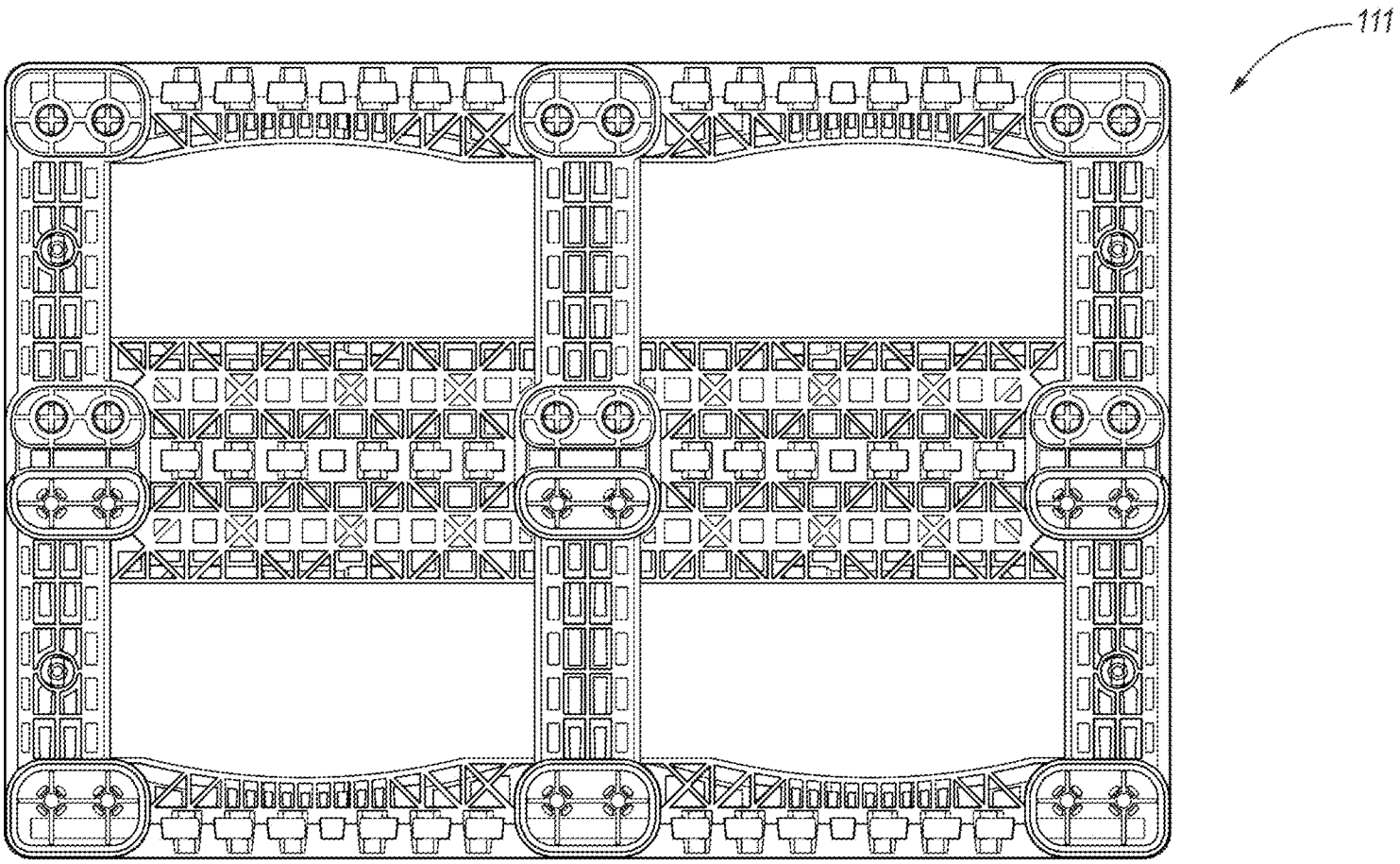
FIG. 11 is a bottom view of the pallet half.

The outer center recess portion 130 is much deeper (downward and outward) than the inner center recess 136 and the ring recess portions 132 are much deeper (downward and outward) than the inner ring recess portions 138. The inner ring recess portions 138 are deeper (downward and inward) than the inner center recess 136. FIG. 11 is a bottom view of the pallet half 111.

Figure 12:
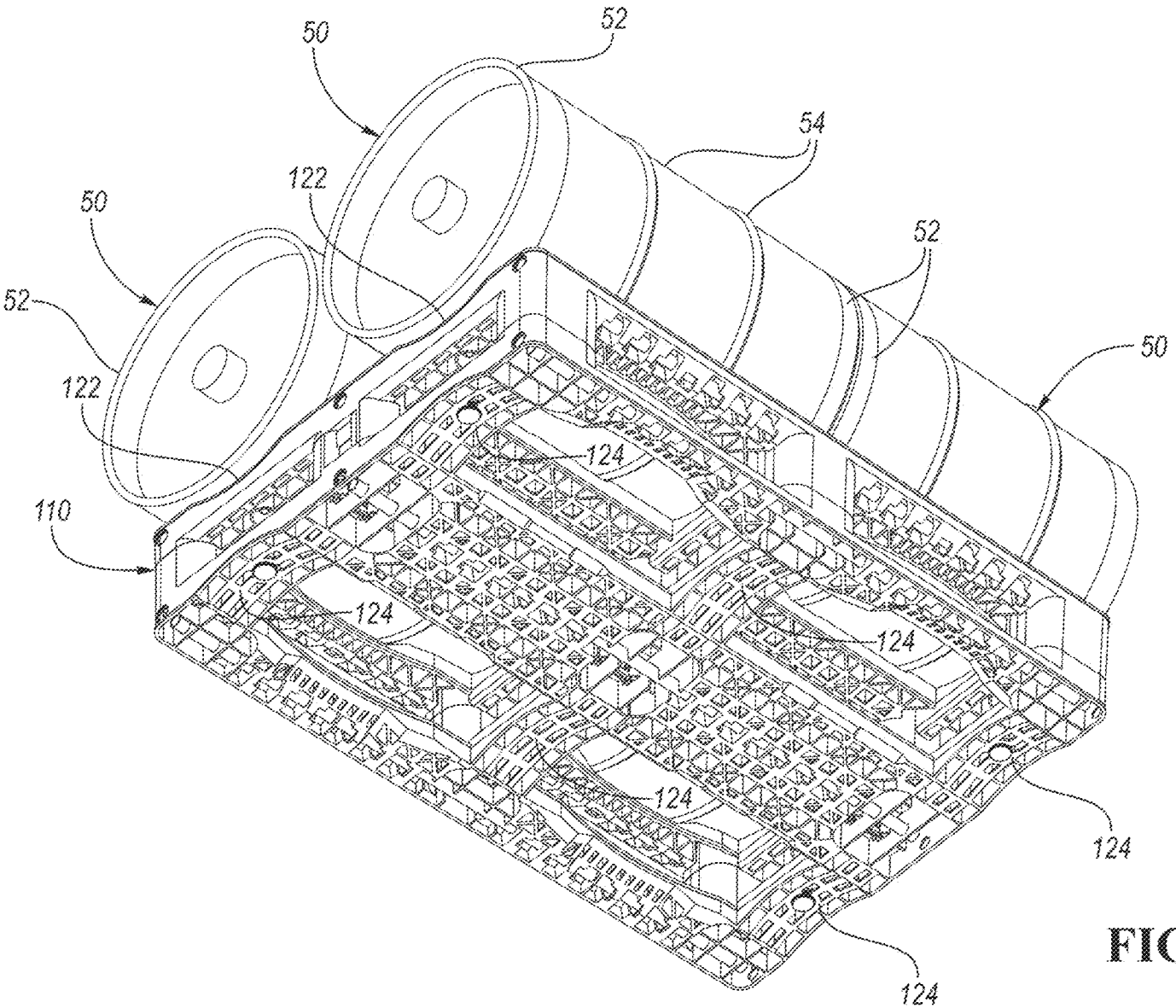
FIG. 12 shows the pallet with four straight kegs stacked thereon.

FIG. 12 shows the pallet 110 with four straight kegs 50 stacked thereon, two in each keg recess 122. Each straight keg 50 includes upper and lower chimes 52 and body portion including a cylindrical wall therebetween. The cylindrical wall has a radius substantially equal to the radius of the upper chime 52 and lower chime 52 but for the areas of increased radius forming a pair of small rings 54 protruding relative to the outer surface of the remainder of the cylindrical wall. The chimes 52 are received in the concave recesses of the keg supports 124. The chimes 52 provide a substantially constant and reliable diameter and surface to support the pallet 110. Referring to FIGS. 1 and 5, the keg supports 124 are contacted by a straight keg 50 both on the top and the bottom of the pallet 110.

Figure 13:
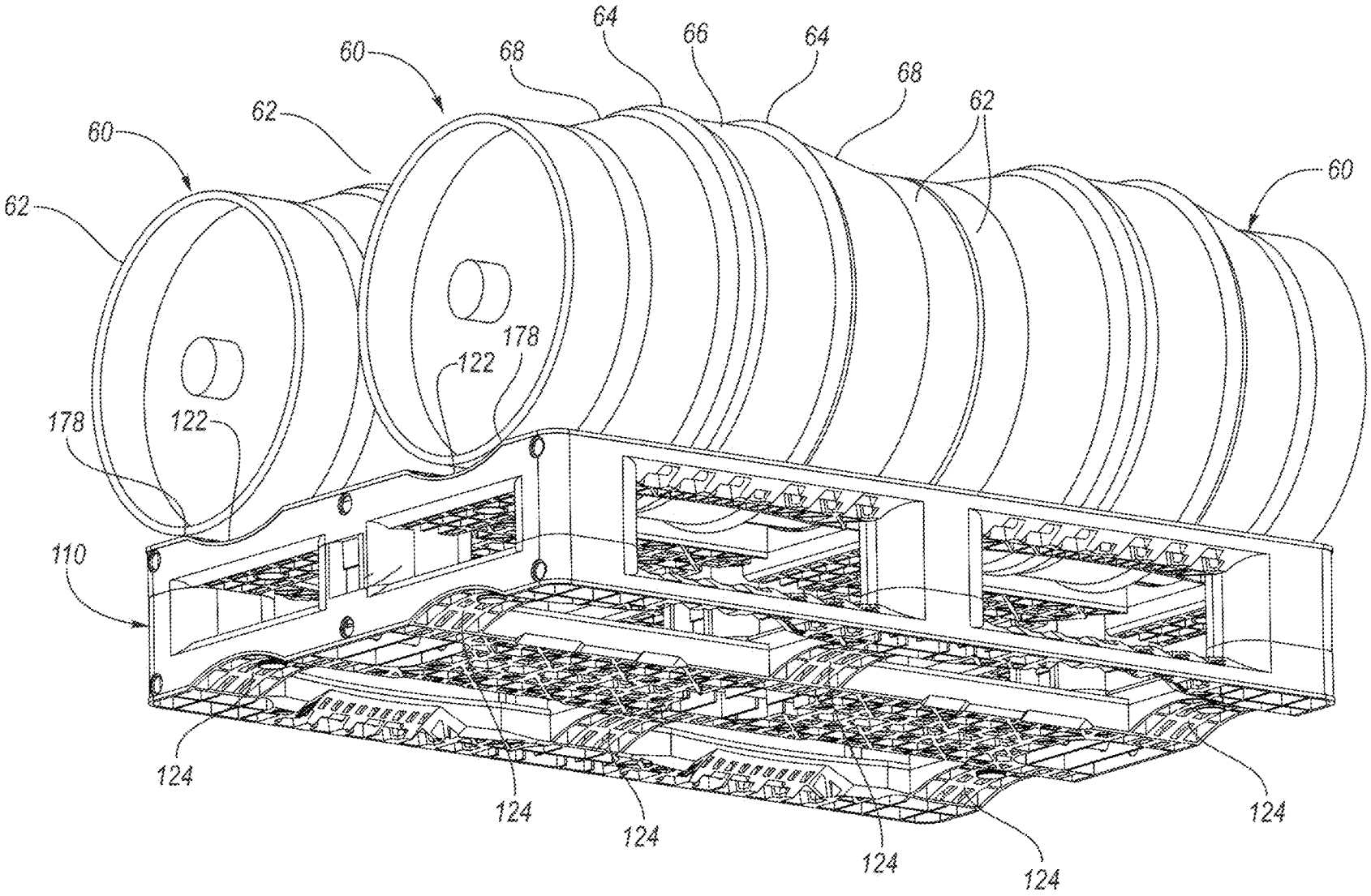
FIG. 13 shows four belly kegs stacked on the pallet.

FIG. 13 shows four belly kegs 60 stacked on the pallet 110. Each belly keg 60 includes a body portion between upper and lower chimes 62. The body portion has a middle area 66 that has a significantly larger radius than that of the upper and lower chime 62. The middle area 66 has two spaced-apart small rings 64 in which the radius is increased a little more. The body portion of the belly keg 60 also has an upper area 68 and a lower area 68 that each taper outward from the respective chime 62 toward the middle area 66.

Referring also to FIG. 10, on the top and the bottom of the pallet 110 the belly keg 60 primarily contacts the center middle recess 128 and the outermost upper edges 178 of the keg supports 124. The upper and lower chimes 62 contact the outermost upper edges 178 of the keg supports 124. On the other side, the keg 60 is supported by the center middle recess 128.

Thus, on the outer portion 120 of the upper deck 112, the weight of the keg 60 is supported exclusively (or primarily, depending on the shape of the keg 60 after years of use) at the upper edges 178 of the keg supports 124, which is where the keg supports 124 join the columns 116. These are the most robust areas of the outer portions 120. On the center portion 118, the weight of the keg 60 is supported on the center middle recess 128, but the entire center portion 118 is strong because it does not have a thin portion as do the outer portions 120.

The belly keg 60 may also contact the outer center recess portion 130, the ring recess portions 132, and the tapered portions 134 on the outer portion 120 (depending on the shape of the keg 60 after years of use) but most of the weight on the outer portion 120 will be at the outermost upper edges 178. The belly keg 60 may also contact the tapered portions 134 on the outer portion 120, but these tapered portions 134 are away from the thinnest part of the outer portion 120 and the corresponding tapered portions of the belly keg 60 are relatively dimensionally stable. The center area of the outer portion 120 (i.e. the outer middle recess 126) may deflect a little, again, depending on the shape of the belly keg 60, but the outermost upper edges 178 will be very rigid, preventing substantial deflection (or breakage) of the center area of the outer portion 120.

Similarly, those same parts of belly kegs 60 below the pallet 110 would be received in the same corresponding recesses in the lower deck 114. Again, the upper deck 112 and lower deck 114 are identical, such that either deck of the pallet 110 can be the "upper" deck or the "lower" deck.

Figure 14:
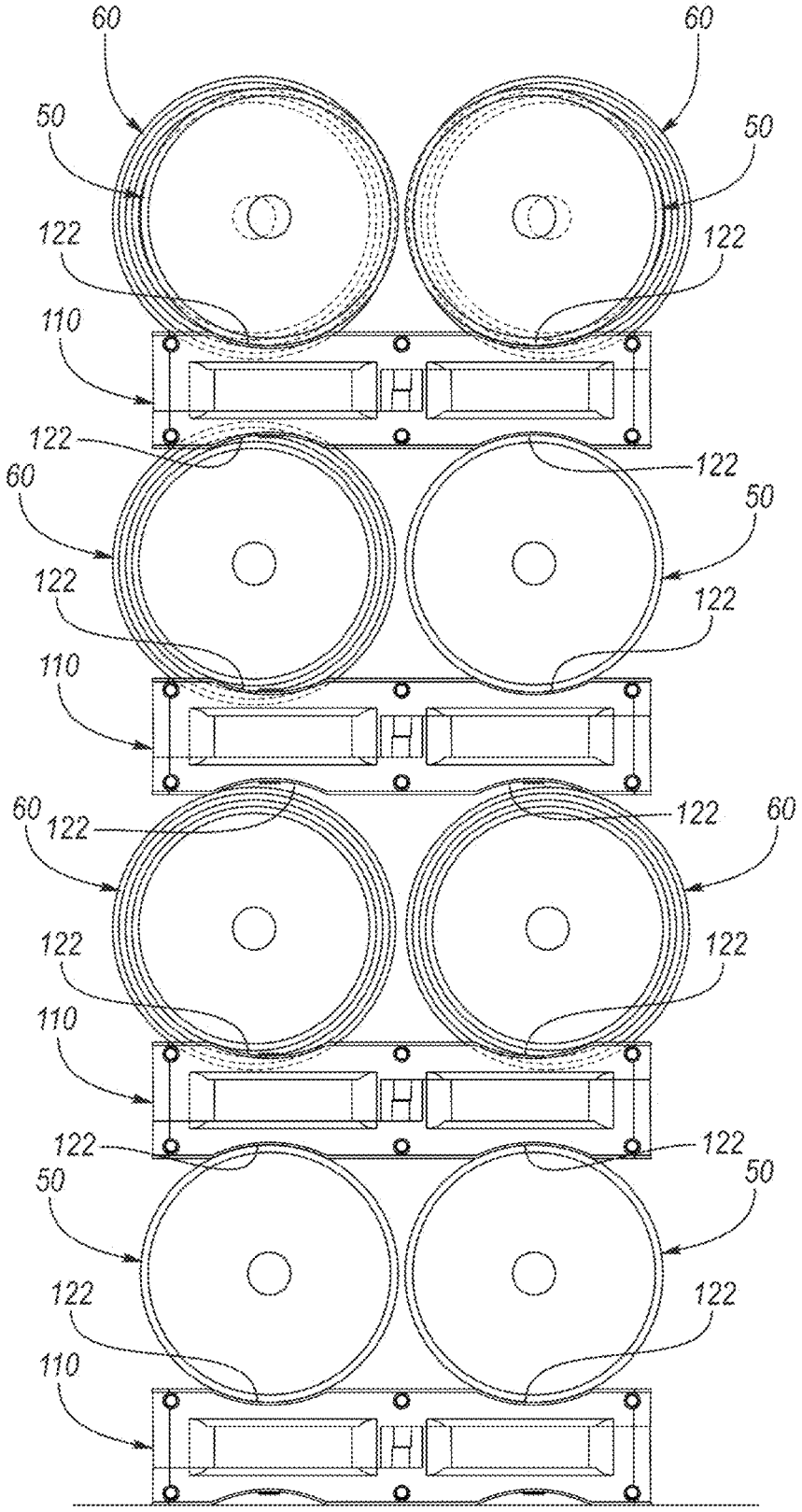
FIG. 14 shows a stack of pallets and straight kegs and belly kegs.

FIG. 14 shows a stack of pallets 110 and kegs 50 and kegs 60, with each pallet 110 (other than the bottom pallet 110) stacked on the kegs below. In FIG. 14, both types of kegs 50 and kegs 60 are shown. A plurality (four) of straight kegs 50 are stacked on the lowermost pallet 110. The second pallet 110 is stacked on the straight kegs 50 on the lowermost pallet 110. A plurality (four) of belly kegs 60 are stacked on the second pallet 110. The third pallet 110 is stacked on the belly kegs 60. In the example shown in FIG. 14, on the third pallet 110 is stacked both straight kegs 50 and belly kegs 60. This demonstrates that, even though the straight kegs 50 and belly kegs 60 have different maximum diameters, they will still stack on the pallets 110 at the same height. Therefore, whether the pallets 110 contain straight kegs 50 or belly kegs 60 or a mixture of both, the overall height will be the same (other than the kegs on the top pallet 110, which will be a little higher if it has belly kegs 60 than if it has straight kegs 50). Therefore, straight kegs 50 and belly kegs 60 can also be placed on the same pallet 110 and still have another pallet 110 stacked thereon that will be stable and level.

On the uppermost pallet 110, both straight kegs 50 and belly kegs 60 are shown superimposed. As can be seen, the height of the centers of the two keg types are the same, although the centers of the belly kegs 60 are positioned slightly outward of the centers of the straight kegs 50.

Referring to FIGS. 12 to 14, the recesses on the lower deck 114 receive the upper surfaces of the straight kegs 50 and belly kegs 60 in the same way as do the recesses on the upper deck 112 so that the pallets 110 stack stably on the straight kegs 50 and belly kegs 60.

As can be seen in FIG. 14, the belly kegs 60 extend deeper into the pallets 110 (both above and below) than do the straight kegs 50. Also, the centers of the belly kegs 60 are spaced further apart than are the centers of the straight kegs 50. As a result, the pallets 110 stack at the same height whether they are loaded with belly kegs 60 or straight kegs 50, and both belly kegs 60 and straight kegs 50 can be placed on the same pallet 110 and still have another pallet 110 stacked stably and evenly thereon.

The pallet 110 can thus be used with both the straight keg 50 and the belly keg 60 and is reversible. Each pallet half 111 is preferably injection molded of a suitable plastic although the elongated reinforcement members 142 may be steel or other metal. The columns 116 could be molded separately and snap-fit, welded or glued to the upper deck 112 and lower deck 114.

In accordance with the provisions of the patent statutes and jurisprudence, exemplary configurations described above are considered to represent a preferred embodiment of the invention. However, it should be noted that the invention can be practiced otherwise than as specifically illustrated and described without departing from its spirit or scope.

What is claimed is:

1. A pallet comprising:

a deck having center portion and two outer portions spaced outward on either side of the center portion, a plurality of keg supports extending from each outer portion to the center portion, wherein each keg support has a concave upper surface, an opening defined between each adjacent pair of keg supports, outer middle recesses formed on each outer portion adjacent each opening, center middle recesses formed on the center portion adjacent each opening; and a plurality of column portions protruding downward from the deck.

2. The pallet of claim 1 wherein the plurality of column portions includes a plurality of male column portions and a plurality of complementary female column portions.

3. The pallet of claim 2 wherein the pallet includes a pallet half in which the plurality of column portions are molded integrally with the deck.

4. The pallet of claim 3 wherein the pallet half is a first pallet half, the pallet further including an identical second pallet half, wherein the plurality of male column portions of the first pallet half are received in the plurality of complementary female column portions of the second pallet half and the plurality of male column portions of the second pallet half are received in the plurality of complementary female column portions of the first pallet half.

5. The pallet of claim 1 wherein the plurality of column portions includes a plurality of male column portions and a plurality of complementary female column portions extending from the center portion of the deck, wherein adjacent pairs of male column portions and female column portions are aligned on opposite sides of a longitudinal center line of the center portion.

6. The pallet of claim 1 wherein the outer middle recesses each include a ring recess portion on either side of an outer center recess portion, wherein each ring recess portion is recessed more deeply than the outer center recess portion.

7. The pallet of claim 6 wherein the outer middle recesses each further include tapered portions that are conical concave outward of the ring recess portions.

8. The pallet of claim 7 wherein the concave upper surface of each keg support is cylindrical concave.

9. The pallet of claim 8 wherein the center middle recesses each include inner ring recess portions on either side of an inner center recess, wherein the inner ring recess portions are deeper than the inner center recess.

10. The pallet of claim 9 further including a reinforcement member received in each outer portion.

11. The pallet of claim 1 in combination with a first keg having an upper chime, a lower chime and a cylindrical wall between the upper chime and the lower chime, the cylindrical wall having a constant radius substantially equal to that of the upper chime and lower chime but having an increased radius to form a pair of rings, wherein the upper chime and the lower chime of the first keg are each received in the concave recess of one of the keg supports.

12. The pallet and first keg of claim 11 in combination with a second keg having an upper chime and a lower chime, the second keg further including a middle area having a radius larger than a radius of the upper chime and the lower chime, the middle area having rings each having an increased radius, wherein the middle area and the rings are received in the center middle recesses of the pallet wherein the upper chime and the lower chime of the second keg each contact an outer edge of one of the plurality of keg supports.

13. The combination of claim 12 wherein the pallet is a first pallet, the combination further including a second pallet identical to the first pallet, wherein the second pallet is stacked on the first keg and the second keg.

14. The combination of claim 13 wherein the upper chime and the lower chime of the first keg are received in the concave recesses of the keg supports of the second pallet and wherein the middle area and the rings of the second keg are received in the outer middle recess and the center middle recess of the second pallet.

15. The pallet of claim 1 wherein the center portion and the two outer portions extend parallel to one another along a longitudinal axis of the pallet, and wherein each adjacent pair of keg supports are spaced away from one another in a longitudinal direction by a distance greater than a longitudinal dimension of each of the keg supports to define the opening between each adjacent pair of keg supports.

16. The pallet of claim 15 wherein each adjacent pair of keg supports are spaced away from one another in the longitudinal direction by a distance a plurality of times greater than the longitudinal dimension of each of the keg supports to define the opening between each adjacent pair of keg supports.

17. The pallet of claim 1 in combination with a first keg having an upper chime and a lower chime, the first keg further including a middle area having a radius larger than a radius of the upper chime and the lower chime, the middle area having rings each having an increased radius, wherein the middle area and the rings are received in the center middle recesses of the pallet wherein the upper chime and the lower chime of the first keg each contact an outer edge of one of the plurality of keg supports.

18. A pallet comprising:

a deck having center portion and two outer portions spaced outward on either side of the center portion, a plurality of keg supports extending from each outer portion to the center portion, wherein each keg support has a concave upper surface, an opening defined between each adjacent pair of keg supports; and a plurality of male column portions and a plurality of complementary female column portions extending downward from the center portion of the deck, wherein each of the plurality of male column portions and each of the plurality of complementary female column portions are elongated along a longitudinal center line of the deck, wherein adjacent pairs of male column portions and female column portions are spaced apart from one another and aligned on opposite sides of the longitudinal center line of the center portion.

19. The pallet of claim 18 wherein the deck is molded integrally with the plurality of male column portions and the plurality of complementary female column portions.

20. The pallet of claim 19 further including a reinforcement member received in the center portion along the longitudinal center line of the center portion.

21. The pallet of claim 19 further including a reinforcement member received in the two outer portions.

22. The pallet of claim 18 wherein the pallet includes a pallet half in which the plurality of male column portions and the plurality of female column portions are molded integrally with the deck, wherein the pallet half is a first pallet half, the pallet further including an identical second pallet half, wherein the plurality of male column portions of the first pallet half are received in the plurality of complementary female column portions of the second pallet half and the plurality of male column portions of the second pallet half are received in the plurality of complementary female column portions of the first pallet half.

23. The pallet of claim 22 further including a reinforcement member received in the two outer portions of each of the first pallet half and the second pallet half.

24. The pallet of claim 18 wherein each of the plurality of keg supports has a longitudinal dimension that is completely between one of the columns below the center portion and one of the columns below one of the outer portions.

25. A pallet comprising:

a first pallet half including a plurality of male column portions and a plurality of complementary female column portions extending from a deck, wherein the plurality of male column portions and the plurality of complementary female column portions are molded integrally with the deck;

a second pallet half identical to the first pallet half, wherein the plurality of male column portions of the first pallet half are received in the plurality of complementary female column portions of the second pallet half and the plurality of male column portions of the second pallet half are received in the plurality of complementary female column portions of the first pallet half;

wherein the plurality of male column portions and the plurality of complementary female column portions extend from a center portion of each of the decks, wherein adjacent pairs of male column portions and female column portions are spaced apart from one another and aligned on opposite sides of a longitudinal center line of the center portion, wherein each of the plurality of male column portions and each of the plurality of complementary female column portions are elongated along the longitudinal center line of the center portion of each of the decks; and at least one reinforcement member received in the deck of the first pallet half.

26. The pallet of claim 25 wherein the at least one reinforcement member includes a first reinforcement member received in the deck of the first half along the longitudinal center line between the adjacent pairs of male column portions and female column portions.

27. The pallet of claim 26 wherein the at least one reinforcement member further includes outer reinforcement members received in two outer portions of the deck of the first half.

28. The pallet of claim 25 wherein the at least one reinforcement member is aligned with three of the plurality of male column portions of the first pallet half.

29. The pallet of claim 25 wherein the first pallet half and the second pallet half each include a plurality of spacer ribs connecting the plurality of male column portions to the plurality of female column portions.

30. The pallet of claim 29 wherein the deck of the first pallet half includes a plurality of ribs and a plurality of aligned apertures formed through the plurality of ribs, wherein the at least one reinforcement member is received in the plurality of aligned apertures.

31. The pallet of claim 30 further including a plurality of interior ribs inside the plurality of male column portions, wherein the plurality of interior ribs are formed integrally with the plurality of male column portions.

32. A pallet comprising:

a deck having center portion and two outer portions spaced outward on either side of the center portion, a plurality of keg supports extending from each outer portion to the center portion, wherein each keg support has a concave upper surface, an opening defined between each adjacent pair of keg supports, outer middle recesses formed on each outer portion adjacent each opening, center middle recesses formed on the center portion adjacent each opening, wherein the outer middle recesses each include a ring recess portion on either side of an outer center recess portion, wherein the outer middle recesses each further include tapered portions that are conical concave outward of the ring recess portions; and a plurality of column portions protruding from the deck.

33. The pallet of claim 32 wherein the concave upper surface of each keg support is cylindrical concave.

34. The pallet of claim 33 wherein the center middle recesses each include inner ring recess portions on either side of an inner center recess, wherein the inner ring recess portions are deeper than the inner center recess.

35. The pallet of claim 34 further including a reinforcement member received in each outer portion.

* * * * *